US005276452A

United States Patent [19]

Schuss et al.

[11] Patent Number: 5,276,452

[45] Date of Patent: Jan. 4, 1994

[54] SCAN COMPENSATION FOR ARRAY ANTENNA ON A CURVED SURFACE

[75] Inventors: Jack J. Schuss, Sharon; Jerome D. Hanfling, Framingham; Jeffrey C. Upton, Groton; Richard L. O'Shea, Holliston; Kaichiang Chang, Northborough, all of Mass.

[73] Assignee: Raytheon Company, Lexington, Mass.

[21] Appl. No.: 904,295

[22] Filed: Jun. 24, 1992

[51] Int. Cl.[5] ..... H01Q 3/22

[52] U.S. Cl. ..... 342/371; 342/373

[58] Field of Search ..... 342/154, 427, 371, 372, 342/373, 377

[56] References Cited

U.S. PATENT DOCUMENTS

| | | | |
|---|---|---|---|
| 3,860,929 | 1/1975 | Crain | 342/427 |
| 4,616,230 | 10/1986 | Antonucci et al. | 342/373 |
| 4,899,160 | 2/1990 | Kawahara | 342/408 |
| 5,017,927 | 5/1991 | Agrawal et al. | 342/371 |
| 5,038,146 | 8/1991 | Troychak et al. | 342/173 |
| 5,081,463 | 1/1992 | Hariu et al. | 342/372 |
| 5,093,667 | 3/1992 | Andricos | 342/372 |
| 5,166,690 | 11/1992 | Carlson et al. | 342/157 |

OTHER PUBLICATIONS

"A Simple Technique to Correct for Curvature Effects on Conformal Phased Arrays," J. Antonucci and P. Franchi, Proceedings of the 1985 Antenna Applications Symposium, Rome Air Development Center, Air Force Systems Command, Griffiss Air Force Base, New York, RADC-TR-85-242 vol. II, Dec. 1985, pp. 607-630.

*Primary Examiner*—Gregory C. Issing

*Attorney, Agent, or Firm*—Walter F. Dawson; Richard M. Sharkansky

[57] ABSTRACT

A low array antenna having transmit/receive (T/R) modules, which contain a digitally-controlled variable attenuator, for each of the two polarizations (horizontal and vertical). The array has a cylindrically curved surface which closely conforms to the shape of the fuselage of an airborne vehicle or another structure. Each polarization feeds into an elevation beamformer apparatus which provides both a uniform taper and a Bayliss/Taylor taper. As the beam is scanned in elevation, the amplitude taper is adjusted via the variable attenuator to control the taper of a sum pattern and thereby achieve low sidelobe far field sum patterns. The same attenuators that are used for the sum pattern also feed a difference network. The T/R module attenuators are set to yield the desired low sidelobe sum illumination for a desired elevation scan angle. As the array is steered in elevation, the Bayliss difference taper is distorted since the fixed elevation beamformer cannot adjust the difference pattern for the new scan angle. A T/R module is provided at each column of the array to combine the distorted Bayliss difference pattern with the compensated Taylor sum pattern output. This combining permits the distorted Bayliss array illumination to be resymmetrized thereby producing a high quality, low sidelobe, compensated Bayliss far field pattern. This apparatus provides for complete compensation of both sum and difference patterns with only a single attenuator at each element of the array and a simple monopulse feed network.

17 Claims, 7 Drawing Sheets

SCAN COMPENSATION FOR ARRAY ANTENNA ON A CURVED SURFACE

The Government has rights in this invention pursuant to Contract No. F30602-88-C-0080, awarded by the Department of the Air Force.

BACKGROUND OF THE INVENTION

This invention relates generally to phased array radar systems and, more particularly, to an illumination taper adjusting apparatus and method which provides scan compensation for a phased array antenna on a curved surface.

In phased array microwave radar systems, it is often required in a monopulse feed network to form two or more simultaneous beams on receive having different weightings. As an example, it may be required in a monopulse feed network to form a sum beam having Taylor weighting and a difference beam having a Bayliss weighting, along a linear array of, illustratively, sixty-four radiating elements.

The curvature of a conformal phased array antenna distorts the radiation pattern when the beam is scanned. In the prior art a paper by John Antonucci and Peter Franchi titled "A Simple Technique to Correct for Curvature Effects on Conformal Phased Arrays," Proceedings of the 1985 Antenna Applications Symposium, Rome Air Development Command, Report No. RADC-TR-85-242, Vol. 2, December 1985, describes a technique of using the sum and difference networks in combination to correct for curvature effects. A variable power divider is used to combine the power in a prescribed proportion at an arbitrary scan angle between the sum and difference channels. This recombination method partially restores the original aperture illumination for the scanned direction. The optimum amount of signal to be distributed to achieve the maximum restoration is found as a function of scan angle and curvature. However, this approach to correct conformal array curvature effects only partially corrects the illumination taper and still results in high sidelobes. In order to fully correct for conformal effects in the prior art, separate phase shifters and attenuators are placed at each radiating element, one for each beam, in order to properly correct for curvature effects. This represents a severe cost multiplier for the fabrication of curved phased array antennas.

The beamforming architecture of the prior art typically uses each column of a phased array to generate simultaneously sum and difference patterns on receive beams. Typically, these beamformers are used in planar arrays where scan compensation of the illumination is not needed or done when the beam is scanned. Similar architectures may be used to combine columns into a two dimensional array. Typically, a single T/R module with a single phase shifter and level set attenuator is used at each radiating element in the phase array. When building a curved or conformal array, it is necessary to limit the T/R module at the radiating elements to one phase shifter and attenuator, as is done with planar arrays, in order to keep array cost, size, volume and weight at reasonable levels.

SUMMARY OF THE INVENTION

It is therefore an object of the present invention to provide a simple array feed for use in a conformal phased array radar system.

It is an additional object of the present invention to provide such a feed which provides illumination compensation as the beam is scanned over a curved surface.

It is a further object of the present invention to provide such a feed which provides continuous retapering of simultaneously formed sum and difference illuminations on receive as the beam is scanned over a curved surface, consistent with using a single T/R module comprising a phase shifter and an attenuator at each element.

In accordance with the principles of the present invention, there is disclosed herein an apparatus for use in a phased array radar system. The apparatus comprises an antenna including N radiating elements disposed on a curved surface, and means for steering a beam of the antenna to an angle comprising only one phase shifter and attenuator means coupled to each of the radiating elements for each polarization excited or received by the antenna. A beamformer coupled to the steering means is provided for shaping and producing two illuminations at the radiating elements according to a sum taper and a difference taper. The apparatus further includes means coupled to the beamformer for maintaining the sum taper as the beam is steered to the angle, the sum taper means comprises means for adjusting with the attenuator means individual attenuation levels for the sum taper. Further, the apparatus includes means coupled to the beamformer for maintaining the difference taper as the beam is steered to the angle, the difference taper maintaining means comprises a conformal compensation network. The curved surface of the array is conformal with the body of an aircraft or some other structure. The apparatus comprises a system controller for generating control signals to select the beam angle, to adjust the individual attenuation levels and to control the conformal compensation network. The beamformer comprises an elevation beamformer at each column and an azimuth beamformer for both the sum and difference beams. The conformal compensation network comprises means for coupling power from a sum taper beamformer output to a difference taper beamformer output.

In the preferred embodiment of the invention the conformal compensation network comprises a T/R module, a first power coupler means coupled between a sum signal from the elevation beamformer and the T/R module for coupling the sum signal from the elevation beamformer to the T/R module, and a second power coupler means coupled between the difference signal from the elevation beamformer and the T/R module for coupling the sum signal from the T/R module to the difference signal. In an alternate embodiment of the invention, the conformal compensation network comprises a T/R module, a first power coupler means coupled between a sum output of the azimuth beamformer and the T/R module for coupling the sum output to the T/R module, and a second power coupler means coupled between a difference output of the azimuth beamformer and the T/R module for coupling the sum output to the difference output.

The objects are further accomplished by a method of providing scan compensation in a phased array radar system comprising the steps of providing an antenna including N radiating elements disposed on a curved surface, steering a beam of the antenna to an angle with only one phase shifter means and attenuator means coupled to each of the radiating elements for each polarization excited or received by the antenna, shaping and producing two illuminations at the radiating elements with a beamformer means according to a sum taper and a difference taper, maintaining the sum taper as the beam is steered to the angle with means coupled to the beamformer means by adjusting attenuation levels of the attenuation means for the sum taper, and maintaining the difference taper as the beam is steered to an angle with a conformal compensation network coupled to the beamformer means. The step of providing an antenna including N radiating elements disposed on a curved surface includes the curved surface being conformal with the body of an aircraft. The step of shaping and producing two illuminations at the radiating elements includes using an elevation beamformer and an azimuth beamformer. The method further comprises the step of generating control signals to select the beam angle, to adjust the attenuation levels, and to control the conformal compensation network. The step of maintaining the difference taper as the beam angle is steered with a conformal compensation network comprises the step of coupling power from the sum taper to the difference taper of the beamformer means in accordance with a compensation control signal. The step of maintaining the difference taper as the beam angle is steered using a conformal compensation network comprises the steps of providing a T/R module, coupling a sum signal from the elevation beamformer to the T/R module with a first power coupler means coupled between the sum signal and the T/R module, coupling the sum signal from the T/R module to a difference signal from the elevation beamformer with a second power coupler means coupled between the difference signal and the T/R module, and controlling the amount of the sum signal coupled to the difference signal via the T/R module in accordance with a compensation control signal. In an alternate embodiment the step of maintaining the difference taper as the beam is steered to an angle with a conformal compensation network comprises tho steps of providing a T/R module, coupling a sum output of the azimuth beamformer to the T/R module with a first power coupler means coupled between the sum output and the T/R module, and coupling the sum output from the T/R module to a difference output of the azimuth beamformer with a second power coupler means coupled between the difference output and the T/R module, and controlling the amount of the sum output being coupled to the difference output via the T/R module in accordance with a compensation control signal.

BRIEF DESCRIPTION OF THE DRAWINGS

Other and further features and advantages of the invention will become apparent in connection with the accompanying drawings wherein.

DESCRIPTION OF THE PREFERRED EMBODIMENT

Figure 1:
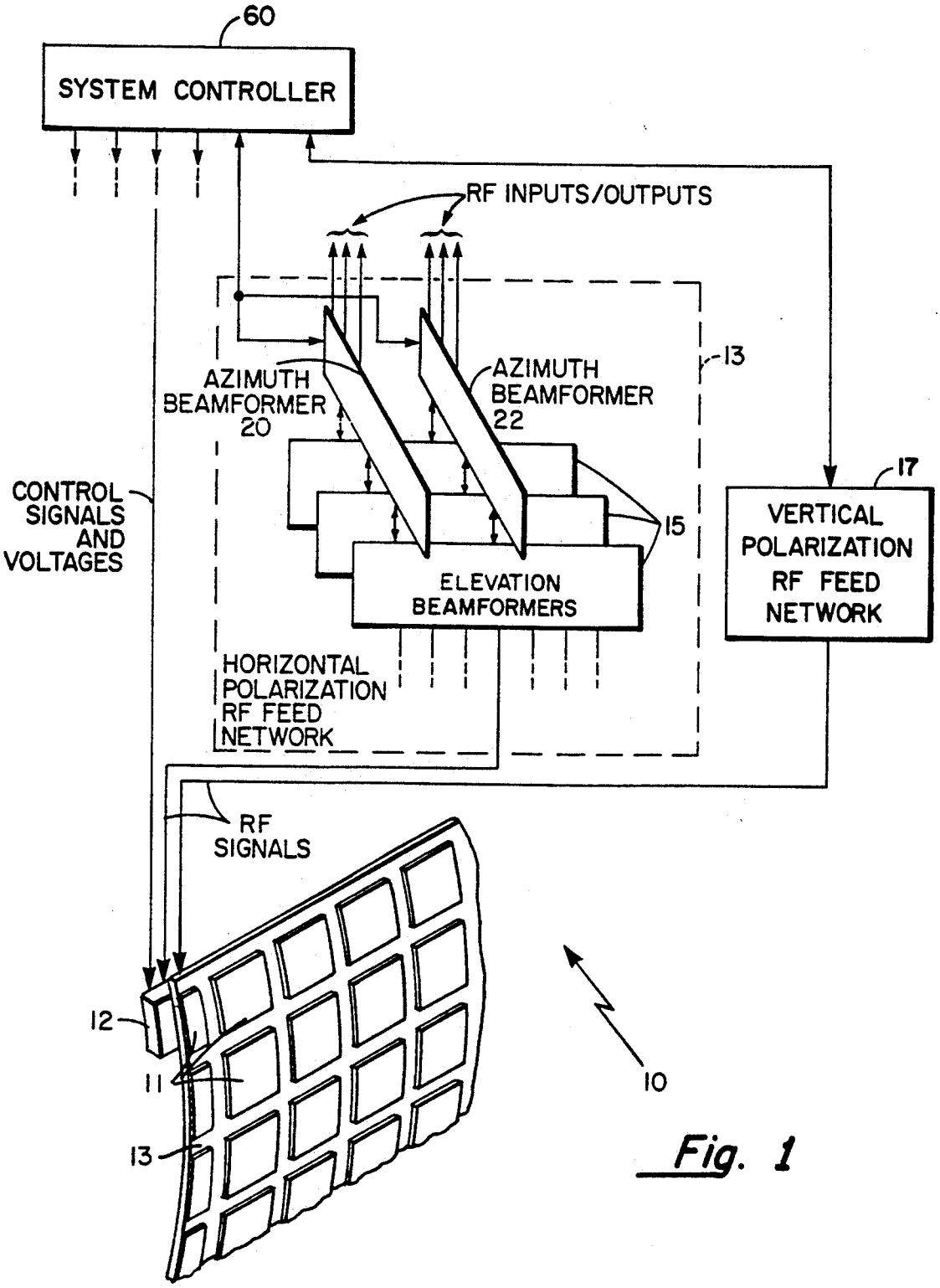
FIG. 1 is a simplified block diagram of a phased array antenna system which includes the present invention.

Referring initially to FIG. 1, it may be seen that a phased array antenna 10 according to the present invention includes a plurality of radiators 11 mounted on a surface 13, which surface 13 conforms substantially to the curved outer surface of the skin of an aircraft or other curved structure onto which it is mounted (not shown). Each radiator 11 is fed by a corresponding transmit/receive (T/R) module 12 attached to the inner side opposite surface 13. T/R modules 12 are driven by a horizontal polarization RF feed network 13 of RF power dividers comprising elevation beamformers 15 and azimuth beamformers 20, 22, which provide RF signals to each of the T/R modules 12. A vertical polarization RF feed network 17 is similar to the horizontal polarization RF feed network 13. Phase information is supplied to each T/R module 12 through a system controller 60. System controller 60 originates the control signals and voltages to the plurality of T/R modules 12.

In a specific application of the present invention, the phased array antenna 10 comprises a linear array of 64 radiators 11 forming a column on surface 13, the array having a radius of curvature of ten feet (3.05 m). The radiators 11 comprise patch radiating elements which are spaced approximately one-half wavelength apart at the upper end of the frequency band.

Figure 2:
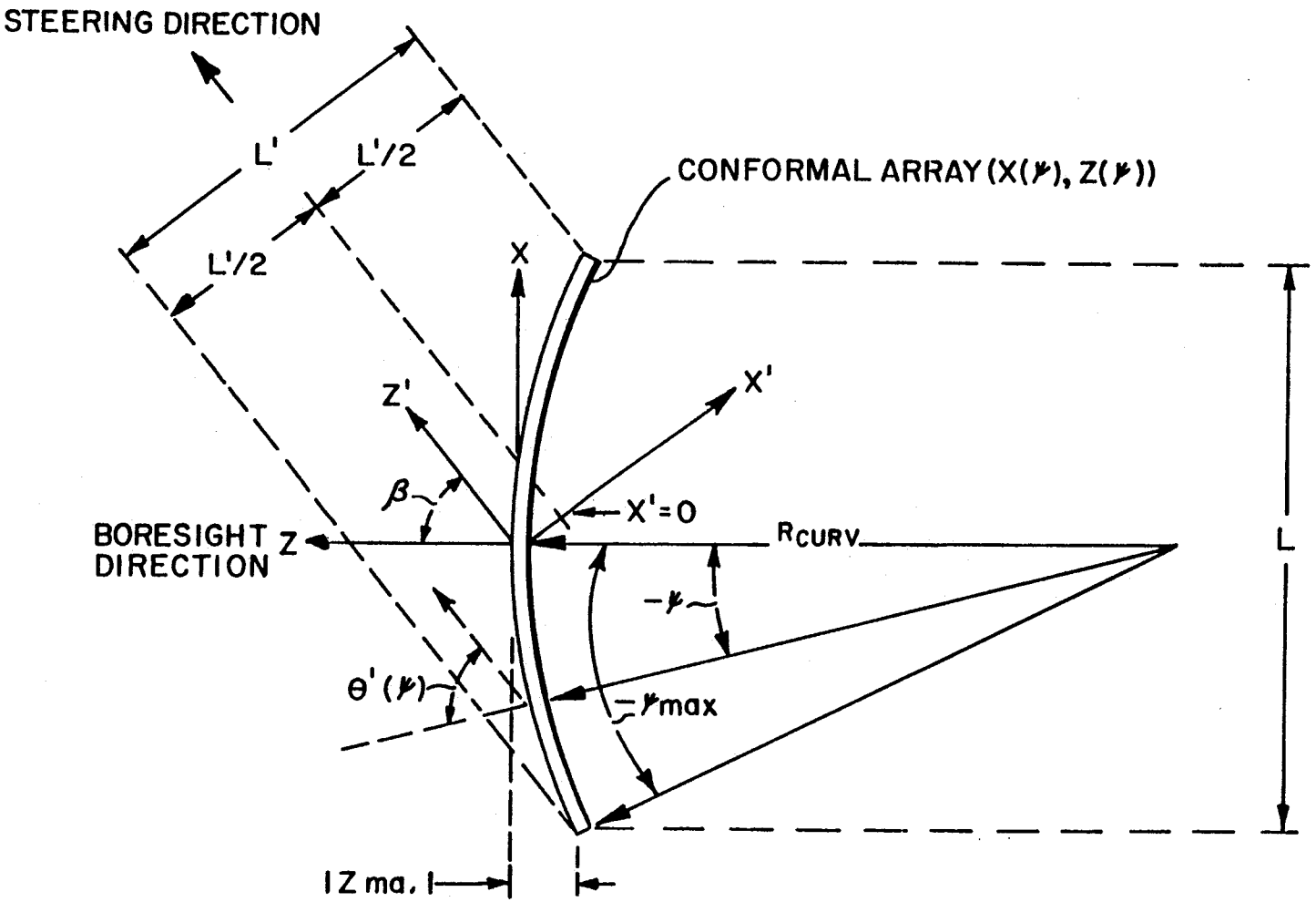
FIG. 2 illustrates a side view of a curved antenna array demonstrating the geometrical considerations thereof.

Referring now to FIG. 2, there is shown a sideview of a curved phased array antenna 10 which illustrates the geometrical considerations which are described in Table 1.

TABLE 1

| Parameter | Description |
|---|---|
| $X(\psi),Z(\psi)$ = | COORDINATES OF CONFORMAL ARRAY SURFACE |
| $L$ = | PROJECTED LENGTH OF ARRAY = $2\,R_{CURV}\,\mathrm{SIN}\psi_{MAX}$ |
| $L'$ = | PROJECTED LENGTH OF ARRAY = $L\,\mathrm{COS}\beta$ |
| $\beta$ = | STEERING ANGLE |
| $\psi$ = | ANGULAR POSITION OF ELEMENT ON ARRAY |
| $\psi_{MAX}$ = | ANGULAR POSITION OF EDGE ELEMENT ON ARRAY |
| $Z_{MAX}$ = | Z DIRECTION POSITION OF EDGE ARRAY ELEMENT |
| = | $R_{CURV}(1\text{-}\mathrm{COS}\psi_{MAX})$ |
| $Z$ = | Z DIRECTION POSITION OF ARRAY ELEMENT |
| = | $-R_{CURV}(1\text{-}\mathrm{COS}\psi)$ |
| $X$ = | X DIRECTION POSITION OF ARRAY ELEMENT |
| = | $R_{CURV}\,\mathrm{SIN}\psi$ |
| $X'$ = | PROJECTED POSITION OF ARRAY ELEMENT AS VIEWED FROM STEERING ANGLE |
| = | $X\,\mathrm{COS}\beta - Z\,\mathrm{SIN}\beta + Z_{MAX}\,\mathrm{SIN}\beta$ |
| $X' = 0$ = | CENTER OF ARRAY VIEWED FROM STEERING ANGLE |
| $\theta'(\psi)$ = | STEERING ANGLE SEEN BY ELEMENT AT POSITION $\psi$ |
| = | $\beta - \psi$ |
| $\mathrm{COS}(\theta'(\psi))$ = | $\mathrm{COS}\beta\,\mathrm{COS}\psi + \mathrm{SIN}\beta\,\mathrm{SIN}\psi$ |

In general, it can be shown that as a curved array is scanned, its illumination function $f_c(\psi)$ must follow the following prescription in order to properly correct itself as the array is scanned:

$$f_c(\psi) = \frac{f(x'/L')\cos(\theta')}{E_e(\cos\theta')}$$

where $f(x'/L')$ is the ideal illumination function of a planar array, $E_e(\cos\theta')$ is the pattern of an array element, and the variables are as defined in FIG. 2. This prescription requires the illumination to translate up the curved surface of the array as the array is scanned, and to distort its amplitude. The prescription for this correction is different depending on whether a sum or difference illumination is used.

Figure 3:
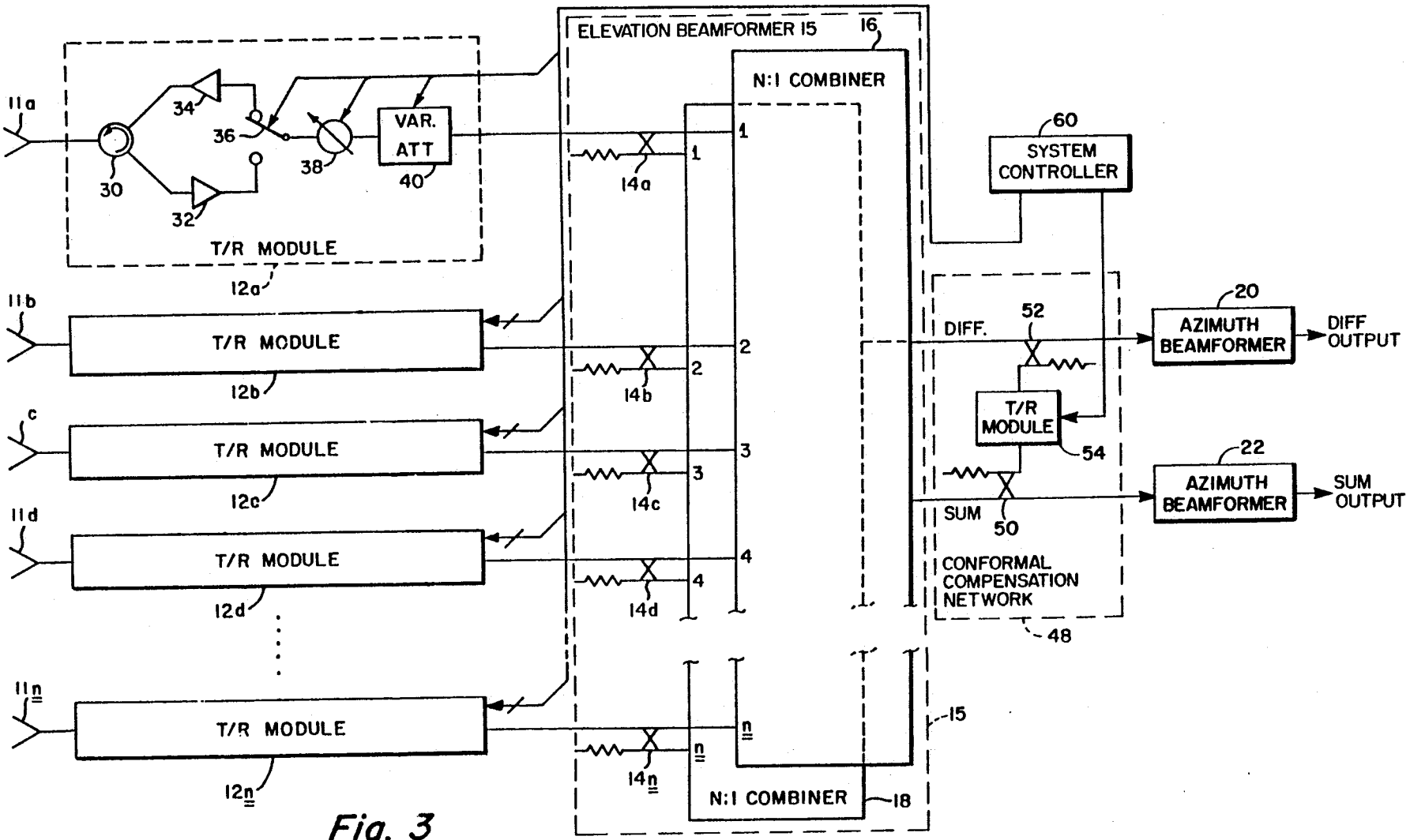
FIG. 3 is a block and schematic diagram of a phased array antenna beamforming apparatus for one of two polarizations according to the present invention.

Referring now to FIG. 3, there is shown a block and schematic diagram of a phased array antenna beamforming apparatus for one of two polarizations in accordance with a preferred embodiment of the present invention. The apparatus includes radiating elements 11a–11n, T/R modules 12a–12n, unequal-split power couplers 14a–14n, first and second N:1 equal-split combiners 16 and 18 forming an elevation beamformer 15, and azimuth beamformers 20 and 22. In addition, there is a conformal compensation network 48 comprising a power coupler 52 coupled to the difference (DIFF) output of combiner 18 and a power coupler 50 coupled to the sum output of combiner 16. Power couplers 50, 52 are coupled to a T/R module 54 which couples a portion of the sum output which is a compensated Taylor sum, pattern to the DIFF output which is a distorted Bayliss difference pattern. The outputs of the conformal compensation network 48 are coupled to azimuth beamformers 20, 22 which generate a difference (DIFF) output and a sum output respectively. Controller 60 generates the beam angle and the parameters for the variable attenuator 40 for accomplishing scan compensation. The totality of radiators 11a–11n are preferably arranged in a single column along a two-dimensional array of elements of the type shown in FIG. 1, and the positioning of these elements 11a–11n along the linear array corresponds, in the preferred configuration, to the input positions of combiners 16 and 18.

In the present example, radiating elements 11a–11n may comprise a patch radiator on a planar or curved surface which is formed by a multiplicity of such elements 11a–11n. Each of the T/R modules 12a–12n illustratively comprises a level set attenuator 40, a phase shifter 38, a T/R switch 36, a low noise amplifier 32 in the receive path, a high power amplifier 34 in the transmit path, and a circulator 30 for the appropriate steering of the transmit and receive signals. Attenuator 40 is preferably a programmable attenuator for which different levels of attenuation may be established by the system controller 60 for the transmit and receive modes. The attenuator 40 in the present embodiment has a different programmed level for transmit and for receive. Phase shifter 38 is, by way of example, a 6-bit phase shifter.

As shown in FIG. 3, the system controller 60 provides amplitude and base data to the variable attenuator 40 and phase shifter 38 in the T/R modules 12a–12n and sets the coupling (attenuation) in T/R module 54 of the conformal compensation network 48. The variable attenuator 40 is set according to the equation for the illumination function ($f_o(\omega)$ as defined hereinbefore. As is readily known to one of ordinary skill in the art, the equation that is used to set the phase o the T/R module 12a–12n is as follow:

$$\phi_1\,(\text{degrees}) = 360^\circ\,(Z_i\cos\theta + X_i\sin\beta + Y_i\sin\alpha)/\lambda$$

where, $\lambda$ = wavelength, $(X_i, Y_i, Z_i)$ is the location of element i, $\sin\alpha$ is the steering angle relative to the Y axis, and $\cos\theta = [1 - \sin^2\alpha - \sin^2\beta]^4$.

$\sin\beta$ is the steering angle relative to the X axis.

the setting of the coupling (attenuation) in T/R module 54 which couples the sum and difference beams together is performed in accordance with the following equations which result in the trimming of both phase and amplitude in T/R module 54:

$$|A| = |F_D(\theta_o)/F_{\Sigma c}(\theta_o)|$$

$$\angle A = \angle\{F_D(\theta_o)/F_{\Sigma c}(\theta_o)\} + 180^\circ$$

where A is the total coupling through the T/R module 54 path, $F_{\Sigma c}(\theta_o)$ is the amplitude of the corrected sum for filed pattern at steering angle $\theta_o$, and $F_d(\theta_o)$ is the far field amplitude of he uncorrected difference pattern at steering angle $\theta_o$.

Figure 7:
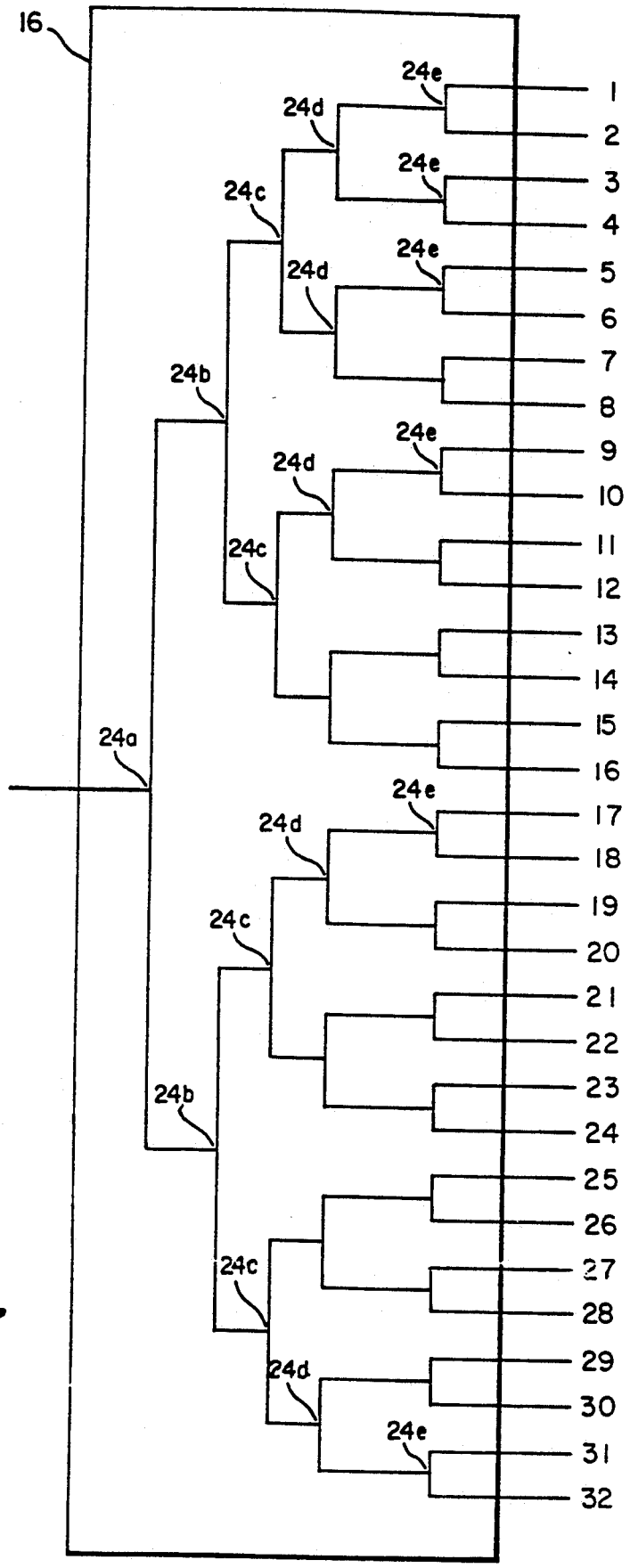
FIG. 7 illustrates the coupling arrangement within a typical combiner of the FIG. 3 and FIG. 4 embodiments.

Unequal-split power couplers 14a–14n is illustratively an overlay hybrid coupler. This device can provide a coupling value from 3 dB to in excess of 40 dB. Combiners 16 and 18 are illustratively 64:1 equal-split combiners. A preferred configuration of a 32:1 equal-split combiner, which may comprise half of the illustrative 64:1 combiner 16 or combiner 18, is shown in greater detail substantially in FIG. 7. Azimuth beamforming networks 20 and 22 are beamformers for shaping in azimuth the beams formed by combiners 16 and 18, respectively. Inputs to azimuth beamformers 20 and 22 shown in FIG. 3, are, in the full implementation of a two-dimensional phased array antenna system, connected respectively, to other N:1 combiners, not explicitly shown in FIG. 3 but illustrated in FIG. 1, corresponding to other columns in the array.

Although, in the preferred embodiment, combiners 16 and 18 are described as equal-split combiners, an application is possible whereby all couplers 14a–14n are 3 dB couplers and combiners 16 and 18 are nonuniform corresponding to the sum and difference patterns. The preferred embodiment represents a low cost way of implementing the elevation beamformer of FIG. 3. It also should be noted that one may wish to set the beamformer 15 to result in a uniform taper or illumination sum pattern for use on transmit. Receive operation can be achieved by using the T/R module attenuators 40 to generate the low sidelobe received taper.

In the illustrative configurations shown in FIG. 1 and FIG. 3, radiator 11a and T/R module 12a are combined into an "antennule" architecture, which may be plugged into a socket on a circuit board (not shown) underlying the array, thereby positioning radiator 11a in the plane of the array. In this arrangement, the circuit board may comprise a multilayer structure including combiners 16 and 18 fabricated as stripline or microstrip conductors, and unequal-split couplers 14a–14n fabricated as overlay hybrid couplers.

Figure 5:
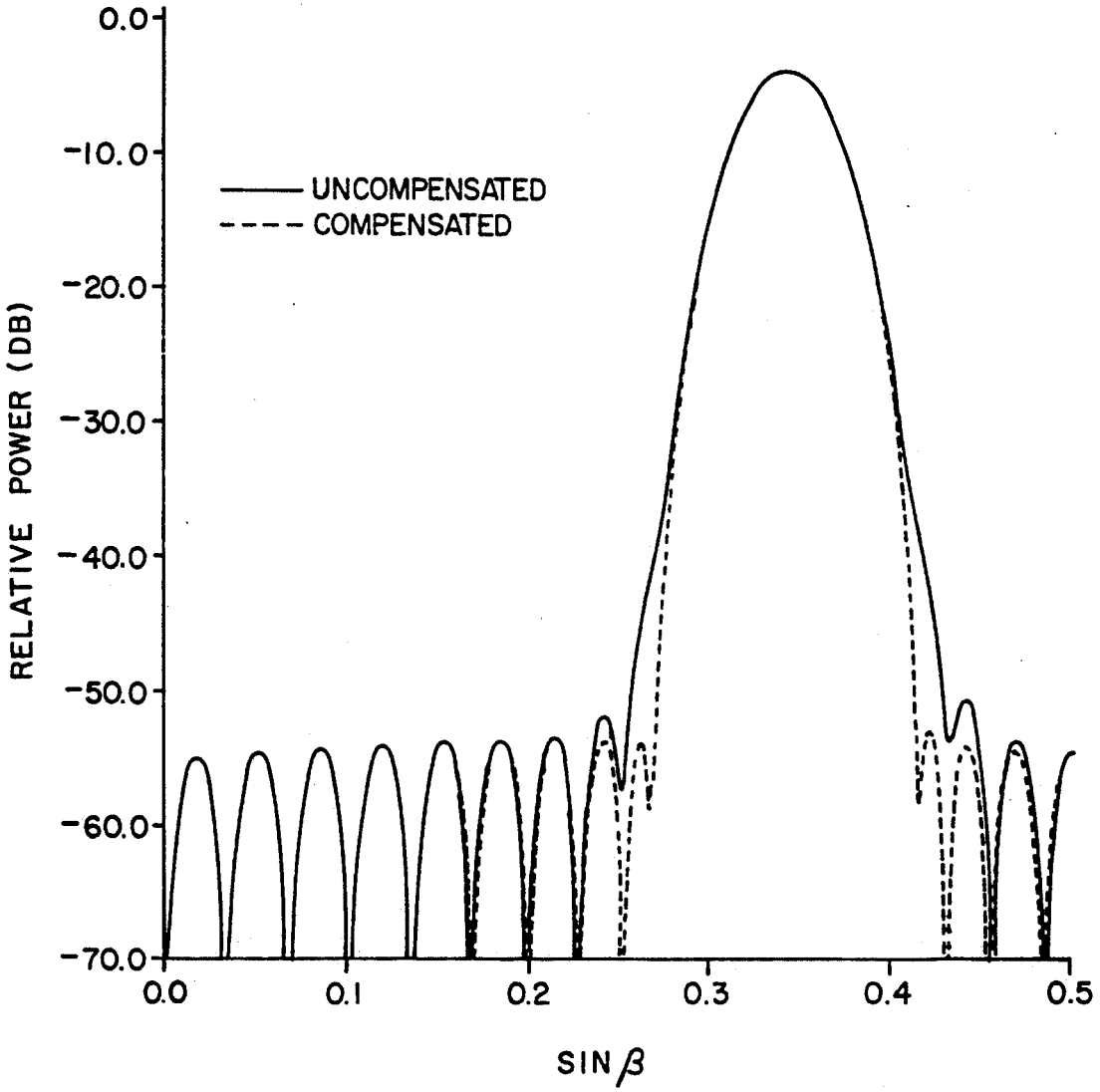
FIG. 5 illustrates uncompensated and compensated antenna patterns for sum beams.

Referring to FIG. 3, the scan compensation method of the present invention for a phased array antenna 10 on a curved surface comprises the use of a single T/R module 12a–12n for sum and difference channels and one additional T/R module 54 in the conformal compensation network 48 at the outputs of the elevation beamformer 15. This method reduces the number of modules at each antenna radiation element 11a–11n and reduces the complexity of the system over the prior art, thereby achieving savings in cost and space. In the receive mode the attenuator 40 in each T/R module 12a–12n is set to produce the desired sum beam Taylor taper. As the beam is scanned in elevation the element amplitudes are adjusted to ideally compensate for the sum beam distortion. The compensated and uncompensated antenna patterns are shown in FIG. 5. The pattern is computed at the midband frequency for a beam scanned 20 degrees in elevation.

Figure 6:
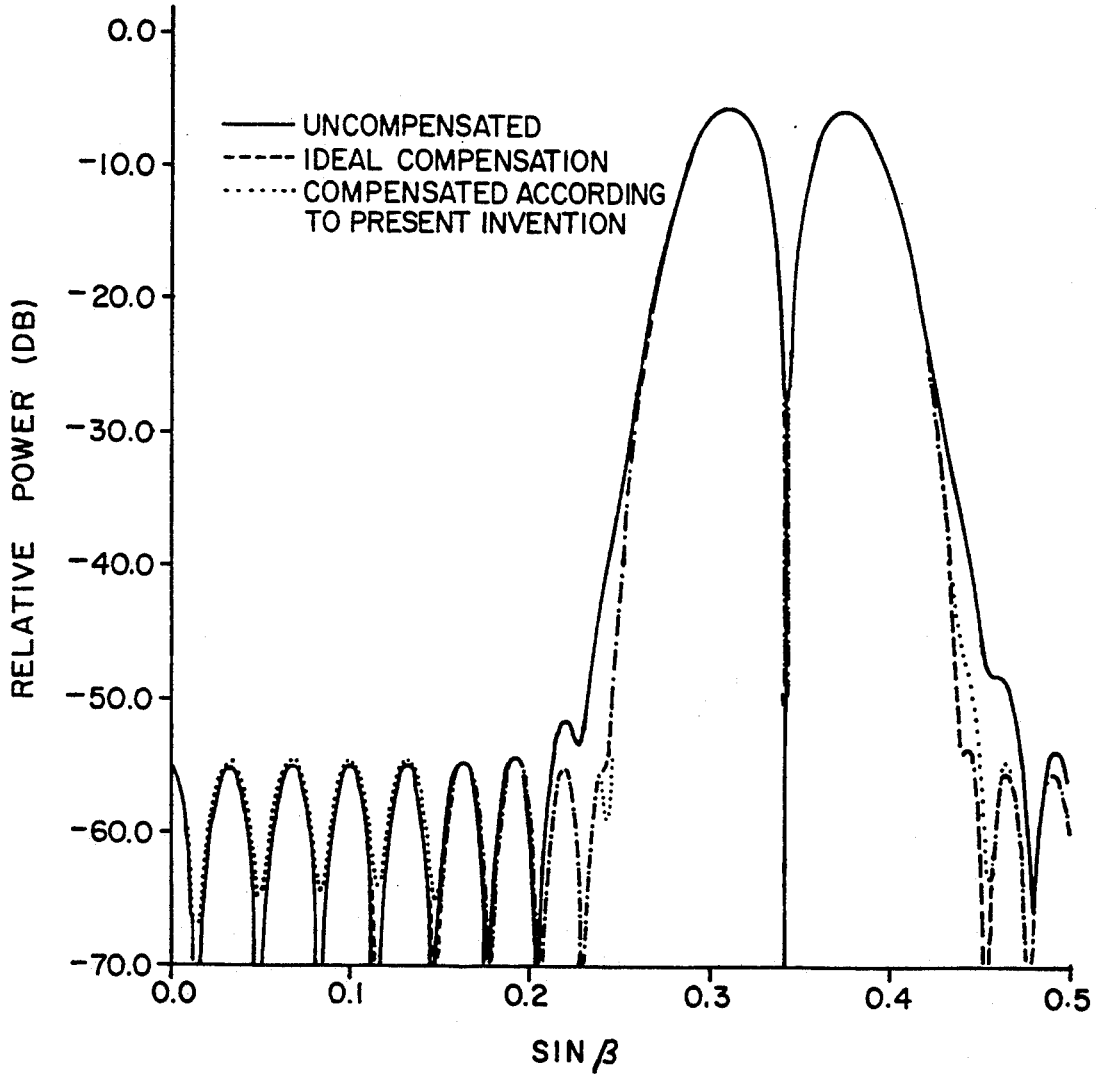
FIG. 6 illustrates uncompensated and compensated antenna patterns for difference beams.

At boresight, the difference beam is formed by using a Bayliss/Taylor power division network comprising couplers 14a–14n and combiner 18 which compensates for the Taylor weights set in the T/R module attenuators 40. The desired Bayliss amplitude taper is therefore generated. However, as the beam is scanned in elevation, the difference beam is distorted. This effect is corrected for by coupling a portion of the sum channel signal from combiner 16 into the difference channel at the output of combiner 18. The coupling occurs in the conformal compensation network 48 at the output of the elevation beamformer 15 as shown in FIG. 3. A single T/R module 54 is placed in each coupled path and allows the coupled signal strength to be adjusted to insure that the proper compensation occurs at any scan angle. FIG. 6 demonstrates the impact of this architecture on the array performance when the difference beam is scanned to 20 degrees in elevation. FIG. 6 depicts th uncompensated (solid plot) and ideally compensated (dashed plot) difference patterns as well as the "practical" compensation (dotted plot) pattern achieved by the present invention. It is apparent that the "practical" compensation method provided by the present invention produces an almost identical pattern when compared to the ideally compensated plot. The coupling introduced by T/R module 54 in order to compensate the difference patterns trims both amplitude and base which are calculated according to the following prescription noted hereinbefore:

$$|A| = |F_D(\theta_o)/F_{\Sigma c}(\theta_o)|$$

$$\angle A = \angle\{F_D(\theta_o)/F_{\Sigma c}(\theta_o)\} + 180°$$

where A is the total coupling through the T/R module 54 path, $F_{\Sigma c}(\theta_o)$ is the amplitude of the corrected sum far field pattern at steering angle $\theta_o$, and $F_D(\theta_o)$ is the far field amplitude of the uncorrected difference pattern at steering angle $\theta_o$. This method corresponds to moving the null of the difference illumination up the surface of the array as the array is scanned so as to resymmetrize the illumination as received from the steering angle.

Figure 4:
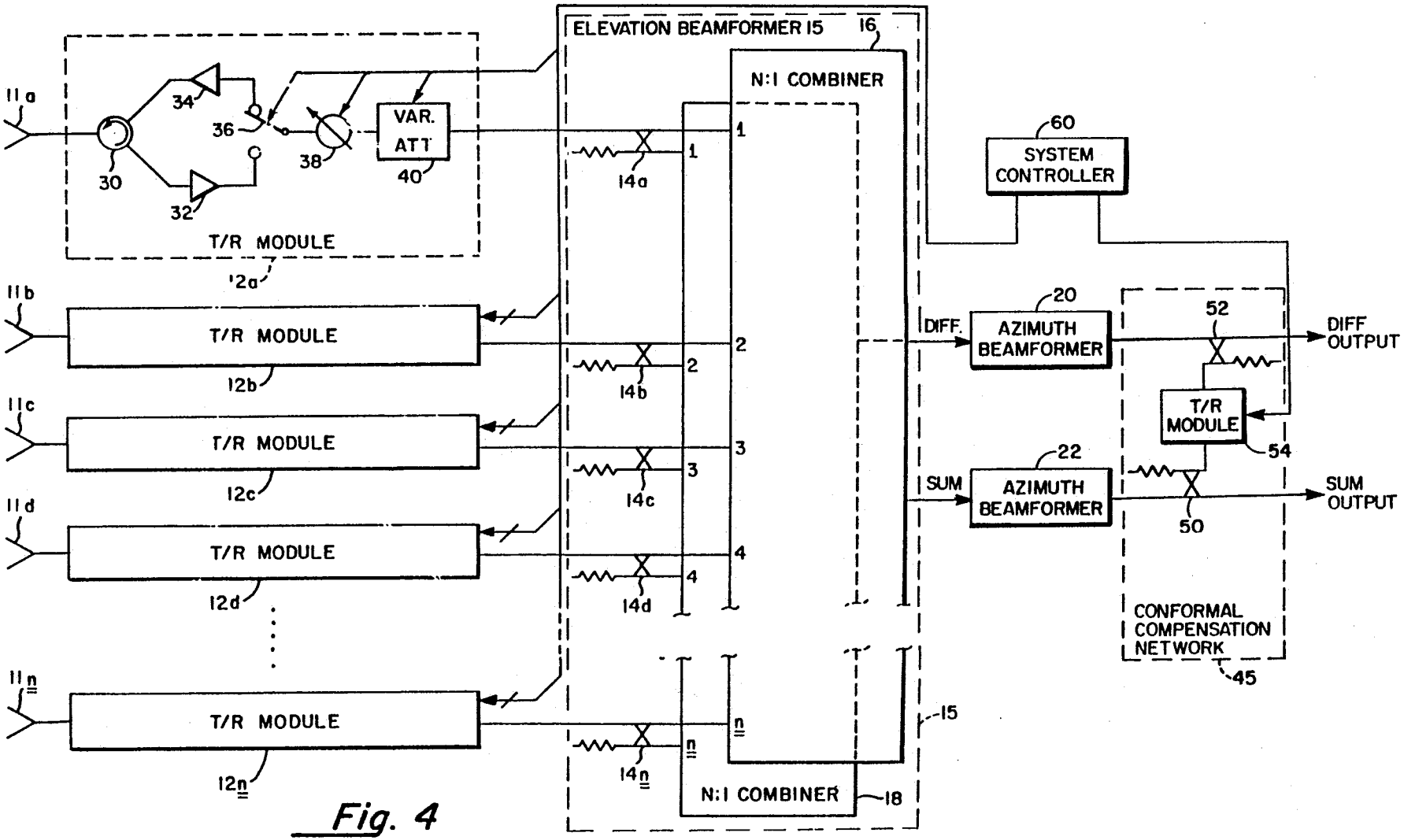
FIG. 4 is a block and schematic diagram of an alternate embodiment of a phased array antenna beamforming apparatus for one of two polarizations showing a conformal compensation network only at the output of azimuth beamformers.

Referring now to FIG. 4, an alternate embodiment of the present invention is shown having only one conformal compensation network 48 comprising the couplers 50, 52 and T/R module 54 connected to the outputs of the azimuth beamformers 20, 22. This alternate embodiment provides for the scan performance as shown in FIGS. 5 and 6, but reduces the count of conformal compensation networks 48 to only on thereby lowering the phased array antenna 10 cost. However, the preferred embodiment provides for more failure tolerance.

Referring to FIG. 5, there is shown a plot of relative beam power (in dB) versus angle (in sin $\beta$) illustrating the sum beams of the phased array antenna 10 for uncompensated (solid plot) and compensated (dashed plot) antenna patterns.

Referring again to FIG. 6, there is shown a plot of relative beam power (in dB) versus angle (in sin $\beta$) illustrating the difference beams of the phased array antenna 10 for uncompensated (solid plot), ideal (dashed plot) and compensated (dotted plot) antenna patterns. As illustrated by these plots, the present invention results in a nearly perfect beam correction using a simple beamformer equal in complexity to that of a planar array.

This concludes the description of the preferred embodiment. However, many modifications and alterations will be obvious to one of ordinary skill in the art without departing from the spirit and scope of the inventive concept Therefore, it is intended that the scope of this invention be limited only by the appended claims.

What is claimed is:

1. An apparatus for use in a phased array radar system, and apparatus comprising:

an antenna including N radiating elements disposed on a curved surface;

means for steering a beam of said antenna to an angle comprising only one phase shifter means and one attenuator means coupled to each of said radiating elements for each polarization excited or received by said antenna;

elevation beamformer means coupled to said steering means for shaping and producing two illuminations at said radiating elements according to a sum taper and a difference taper;

means coupled to said elevation beamformer means for collecting sum outputs of said elevation beamformer means to form a sum beam collimated in azimuth and elevation;

means coupled to said elevation beamformer means for maintaining said difference taper as said beam is steered to said angle, said difference taper maintaining means comprises a conformal compensation network; and azimuth beamformer means coupled to is conformal compensation network for collecting difference outputs from said conformal compensation network to form a difference beam collimated in azimuth and elevation.

2. The apparatus as recited in claim 1 wherein:

said curved surface is conformal with the body of an aircraft.

3. The apparatus as recited in claim 1 wherein:

said apparatus comprises a controller means for generating control signals to select said beam angle, to adjust said individual attenuation levels, and to control said conformal compensation network.

4. The apparatus as recited in claim 1 wherein said conformal compensation network comprises means for coupling power from a sum taper output of said beamformer means to a difference taper output of said beamformer means.

5. The apparatus as recite in claim 1 wherein said conformal compensation network comprises:

a T/R module;

a first power coupler means coupled between a sum signal from said elevation beamformer means and said T/R module for coupling said sum signal to said T/R module; and a second power coupler means coupled between said difference signal from said elevation beamformer means and said T/R module for coupling said sum signal form said T/R module to said difference signal.

6. The apparatus as recited in claim 5 wherein said T/R module comprises:

said phase shifter means;

said attenuator means coupled to said phase shifter means, said attenuator means being set in accordance with an attenuator control signal; and amplifier means coupled to an output of said phase shifter means.

7. A method of providing scan compensation in a phase array radar system comprising the steps of:

providing an antenna including N radiating elements disposed on a curved surface;

steering a beam of said antenna to an angle with only one phase shifter means and one attenuator means coupled to each of said radiating elements for each polarization excited or received by said antenna;

shaping and producing two illuminations at said radiating elements with an elevation beamformer means according to a sum taper and a difference taper;

collecting sum outputs of said elevation beamformer means to form a sum beam collimated in azimuth and elevation;

maintaining said difference taper as said beam is steered to said angle with a conformal compensation network coupled to said elevation beamformer means; and collecting difference outputs from said conformal compensation network with azimuth beamformer means to form a difference beam collimated in azimuth and elevation.

8. The method as recited in claim 7 wherein said step of providing an antenna including N radiating elements disposed on a curved surface includes said curved surface being conformal with the body of an aircraft.

9. The method as recited in claim 7 wherein said method further comprises the step of generating control signals to select said beam angle, to adjust said attenuation levels, and to control said conformal compensation network.

10. The method as recited in claim 7 wherein said step of maintaining said difference taper as said beam angle is steered with a conformal compensation network comprises the step of coupling power from said sum taper to said difference taper of said beamformer means in accordance with a compensation control signal.

11. The method as recited in claim 7 wherein said step of maintaining said difference taper as said beam is steered to ana angle using a conformal compensation network comprises the step of:

providing a T/R module;

coupling a sum signal from said elevation beamformer means to said T/R module with a first power coupler means coupled between said sum signal and said T/R module;

coupling said sum signal from said t/R module to a difference signal from said elevation beamformer means with a second power coupler means coupled between said difference signal and said T/R module; and controlling the amount of said sum signal coupled to said difference signal via said T/R module in accordance with a compensation control signal.

12. An apparatus for use in a phased array radar system, said apparatus comprising:

an antenna including N radiating elements disposed on a curved surface;

means or steering a beam of said antenna to an angle comprising only one phase shifter means and one attenuator means coupled to each of said radiating elements for each polarization excited or received by said antenna;

elevation beamformer means coupled to said steering means for shaping and producing two illuminations at said radiating elements according to a sum taper and a difference taper;

first azimuth beamformer means coupled to said elevation beamformer means for collecting sum outputs of said elevation beamformer means to form a sum beam collimated in azimuth and elevation;

second azimuth beamformer means coupled to said elevation beamformer means for collecting difference outputs of said elevation beamformer to form a difference beam collimated in azimuth and elevation; and means coupled to said first and second azimuth beamformer means for maintaining said difference taper as said beam is steered to said angle, said difference taper maintaining means comprises a conformal compensation network.

13. The apparatus as recited in claim 12 wherein:

said curved surface is conformal with th body of an aircraft.

14. The apparatus as recited in claim 12 wherein:

said apparatus comprises a controller means for generating control signals to select said beam angle, to adjust said individual attenuation levels, and to control said conformal compensation network.

15. The apparatus as recited in claim 12 wherein said conformal compensation network comprises means for coupling power from a sum taper output of said second azimuth beamformer means to a difference taper output of said first azimuth beamformer means.

16. The apparatus as recited in claim 12 wherein said conformal compensation network comprises:

a T/R module;

a first power coupler means coupled between a sum output of said second azimuth beamformer means and said T/R module for coupling said sum output to said T/R module; and a second power coupler means coupled between a difference output of said second azimuth beamformer means and said T/R module for coupling said sum output to said difference output.

17. The apparatus as recited in claim 14 wherein said T/R module comprises:

said phase shifter means;

said attenuator means coupled to said phase shifter means, said attenuator means being set in accordance with an attenuator control signal; and amplifier means coupled to an output of said phase shifter means.

* * * * *